US010030480B2

(12) United States Patent
Reinhardt et al.

(10) Patent No.: US 10,030,480 B2
(45) **Date of Patent: *Jul. 24, 2018**

(54) DEBRIS BARRIER ASSEMBLY

(71) Applicant: Weatherford Technology Holdings, LLC, Houston, TX (US)

(72) Inventors: Paul Andrew Reinhardt, Houston, TX (US); Gordon Thomson, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 794 days.

This patent is subject to a terminal disclaimer.

(21) Appl. No.: 14/304,663

(22) Filed: Jun. 13, 2014

(65) Prior Publication Data

US 2014/0290933 A1 Oct. 2, 2014

Related U.S. Application Data

(63) Continuation of application No. 13/007,998, filed on Jan. 17, 2011, now Pat. No. 8,807,231.

(51) Int. Cl.

| | |
|---|---|
| ***E21B 41/00*** | (2006.01) |
| ***E21B 23/01*** | (2006.01) |
| ***E21B 33/04*** | (2006.01) |
| ***E21B 33/12*** | (2006.01) |
| ***E21B 43/10*** | (2006.01) |
| ***E21B 23/00*** | (2006.01) |

(52) U.S. Cl.

CPC ..... *E21B 41/00* (2013.01); *E21B 23/00* (2013.01); *E21B 23/01* (2013.01); *E21B 33/04* (2013.01); *E21B 33/12* (2013.01); *E21B 43/103* (2013.01)

(58) Field of Classification Search

CPC ..... E21B 41/00; E21B 23/01; E21B 23/00; E21B 33/12; E21B 33/04; E21B 43/103

See application file for complete search history.

(56) References Cited

U.S. PATENT DOCUMENTS

| | | | |
|---|---|---|---|
| 4,125,155 | A | 11/1978 | Brock, Jr. |
| 4,934,460 | A | 6/1990 | Coronado |
| 5,083,623 | A | 1/1992 | Barrington |
| 5,145,228 | A | 9/1992 | Boyle |
| 5,582,253 | A | 12/1996 | Fraser |
| 5,628,366 | A | 5/1997 | Telfer |

(Continued)

*Primary Examiner* — Blake E Michener

(74) *Attorney, Agent, or Firm* — Patterson & Sheridan, LLP

(57) ABSTRACT

A method and apparatus for a debris barrier assembly having a sleeve, an outer housing assembly coupled to the sleeve, and first and second biasing members disposed within the outer housing assembly. A support member is coupled to the sleeve and is in contact with an end of the first and second biasing members. The debris barrier assembly is coupled to a polished bore receptacle to prevent debris from entering the PBR. The debris barrier assembly is operable to compensate for a pressure differential between the internal region of the PBR and the external region of the surrounding wellbore. The debris barrier assembly and the PBR may be run in the wellbore on a work string, and the sleeve may be actuated to actuate a downhole tool connected to the sleeve to perform a downhole operation. The debris barrier assembly may be retrieved from the wellbore using the work string.

27 Claims, 10 Drawing Sheets

(56) References Cited

U.S. PATENT DOCUMENTS

| | | | | |
|---|---|---|---|---|
| 5,775,433 | A * | 7/1998 | Hammett | E21B 17/06 166/381 |
| 7,604,048 | B2 | 10/2009 | Kossa et al. | |
| 7,909,095 | B2 | 3/2011 | Richards et al. | |
| 8,807,231 | B2 * | 8/2014 | Reinhardt | E21B 33/04 166/243 |
| 2002/0157837 | A1 | 10/2002 | Bode et al. | |
| 2003/0132007 | A1 | 7/2003 | Howlett et al. | |
| 2004/0221984 | A1 | 11/2004 | Cram | |
| 2005/0072572 | A1 | 4/2005 | Churchill | |
| 2009/0090518 | A1 | 4/2009 | Coon et al. | |
| 2009/0277639 | A1 | 11/2009 | Schultz et al. | |
| 2011/0108266 | A1 | 5/2011 | Smith et al. | |

* cited by examiner

DEBRIS BARRIER ASSEMBLY

BACKGROUND OF THE INVENTION

Field of the Invention

Embodiments of the invention generally relate to methods and apparatus for a debris barrier assembly for downhole tools.

Description of the Related Art

Wells are typically formed using two or more strings of casing. Generally, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps with the lower portion of the upper string of casing. The second "liner" string is then fixed or "hung" off of the upper surface casing. Afterwards, the liner is also cemented. This process is typically repeated with additional liner strings until the well has been drilled to total depth.

The process of fixing a liner to a string of surface casing or other upper casing string involves the use of a liner hanger and a packer assembly. The liner hanger is typically run into the wellbore above the liner string itself. The liner hanger is actuated once the liner is positioned at the appropriate depth within the wellbore. The liner hanger is typically set through actuation of slips which ride outwardly on cones in order to frictionally engage the surrounding string of casing. The liner hanger operates to suspend the liner from the casing string. The packer assembly is connected above the liner hanger and may be actuated to provide a seal between the liner and the casing. A polished bore receptacle ("PBR") is connected above the packer assembly to facilitate setting of the packer.

The assembly of liner, liner hanger, and packer assembly are typically run into the well using a running assembly having a running tool, a setting assembly, and a debris barrier. One type of debris barrier is known as a junk bonnet. The running assembly is inserted into the PBR and the liner. The running tool is actuated to releasably retain the liner assembly. The setting assembly is positioned above the running tool and includes a plurality of spring-loaded dogs. The debris barrier is connected above the setting assembly and proximate an upper portion of the PBR. The debris barrier is intended to prevent debris from entering the PBR, such as during the cementing process. After actuating the liner hanger, the packer is set by lifting the setting assembly above the PBR to allow the spring loaded dogs to spring radially outward. Thereafter, the dogs are urged against the top end of the PBR to apply an axial force downward to set the packer.

While lifting the setting assembly out of the PBR, the top end of the debris barrier is also lifted out of the PBR. Without the debris barrier plugging the PBR, the top end of the PBR is opened to the wellbore. Debris is thus allowed to enter the PBR. The debris may disrupt the performance of the operation by entering the tool assemblies or fluid passages.

There is a need, therefore, for a debris barrier adapted to prevent debris to enter the PBR or other tools during the liner installation process.

SUMMARY OF THE INVENTION

In one embodiment, a debris barrier assembly for connection to a work string may include a sleeve coupled to the work string; an outer housing assembly coupled to the sleeve; a first biasing member and a second biasing member disposed within the outer housing assembly; and a support member in contact with an end of the first biasing member and an end of the second biasing member, wherein the support member is coupled to the sleeve.

In one embodiment, a downhole assembly for connection to a work string may comprise a debris barrier assembly having a sleeve that is coupled to the work string, and an outer housing assembly coupled to the sleeve; and a polished bore receptacle coupled to the work string, wherein the outer housing assembly is coupled to an upper end of the polished bore receptacle and configured to prevent contamination of a clean fluid volume disposed within the polished bore receptacle.

In one embodiment, a method of performing a downhole operation may comprise running a downhole assembly in a wellbore via a work string, wherein the downhole assembly includes a debris barrier assembly, a polished bore receptacle, an expansion tool, and an expandable tubular, wherein the debris barrier assembly sealingly engages an upper end of the polished bore receptacle; preventing wellbore debris from entering an upper end of the polished bore receptacle using the debris barrier assembly; actuating a sleeve of the debris barrier assembly to move the expansion tool through the expandable tubular; expanding the expandable tubular, thereby securing the polished bore receptacle and the expandable tubular in the wellbore; and retrieving the work string, the debris barrier assembly, and the expansion tool from the wellbore.

In one embodiment, a method of performing a downhole operation may comprise running a downhole assembly in a wellbore, wherein the downhole assembly includes a debris barrier assembly coupled to a polished bore receptacle, wherein the debris barrier assembly includes an outer housing assembly partially disposed above an upper end of the polished bore receptacle; moving the outer housing assembly relative to the polished bore receptacle, thereby opening fluid communication between the polished bore receptacle and the wellbore; and preventing wellbore debris from entering the upper end of the polished bore receptacle using the debris barrier assembly.

In one embodiment, a debris barrier assembly for use with a polished bore receptacle may comprise an outer housing mounted around, and axially movable relative to, an inner member, the outer housing being at least partially disposed inside an upper portion of the polished bore receptacle; a first seal between the outer housing and an inner surface of the polished bore receptacle; a second seal between an inner surface of the outer housing and an outer surface of the inner member; a first biasing member coupled to the outer housing and the inner member, which acts to bias the outer housing towards a first axial position on the inner member; wherein when the outer housing is located at the first axial position, the first and second seals prevent transfer of fluid between an interior and exterior of the polished bore receptacle; wherein when the outer housing is moved in a first direction to a second axial position against the bias of the first biasing member, the first and second seals prevent transfer of fluid between the interior and exterior of the polished bore receptacle; and wherein when the outer housing is further moved in the first direction to a third axial position, one of the first and second seals is bypassed, thereby permitting transfer of fluid between the interior and exterior of the polished bore receptacle.

In one embodiment, a liner hanger assembly may comprise a liner hanger; a polished bore receptacle attached to the liner hanger; and a debris barrier assembly comprising: an outer housing mounted around, and axially movable relative to, an inner member, the outer housing being at least partially disposed inside an upper portion of the polished bore receptacle; a first seal between the outer housing and an inner surface of the polished bore receptacle; a second seal between an inner surface of the outer housing and an outer surface of the inner member; a first biasing member coupled to the outer housing and the inner member, which acts to bias the outer housing towards a first axial position on the inner member; wherein when the outer housing is located at the first axial position, the first and second seals prevent transfer of fluid between an interior and exterior of the polished bore receptacle; wherein when the outer housing is moved in a first direction to a second axial position against the bias of the first biasing member, the first and second seals prevent transfer of fluid between the interior and exterior of the polished bore receptacle; and wherein when the outer housing is further moved in the first direction to a third axial position, one of the first and second seals is bypassed, thereby permitting transfer of fluid between the interior and exterior of the polished bore receptacle.

In one embodiment, a debris barrier assembly for use with a polished bore receptacle may comprise an outer housing mounted around, and axially movable relative to, an inner member, the outer housing being at least partially disposed inside an upper portion of the polished bore receptacle; a first seal between the outer housing and an inner surface of the polished bore receptacle; a second seal between an inner surface of the outer housing and an outer surface of the inner member; a first biasing member coupled to the outer housing and the inner member, which acts to bias the outer housing towards a first axial position on the inner member; a second biasing member coupled to the outer housing and the inner member, which acts to bias the outer housing towards the first axial position on the inner member, wherein the second biasing member acts in a direction opposite to the bias of the first biasing member; wherein when the outer housing is located at the first axial position, the first and second seals prevent transfer of fluid between an interior and exterior of the polished bore receptacle; wherein when the outer housing is moved in a first direction to a second axial position against the bias of the first biasing member, one of the first and second seals is bypassed, thereby permitting transfer of fluid between the interior and exterior of the polished bore receptacle; and wherein when the outer housing is moved in a second direction, opposite to the first direction, to a third axial position against the bias of the second biasing member, the other of the first and second seals is bypassed, thereby permitting transfer of fluid between the interior and exterior of the polished bore receptacle.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 7A-1 is a schematic representation of the embodiment illustrated in FIG. 7A.

DETAILED DESCRIPTION

Figure 1:
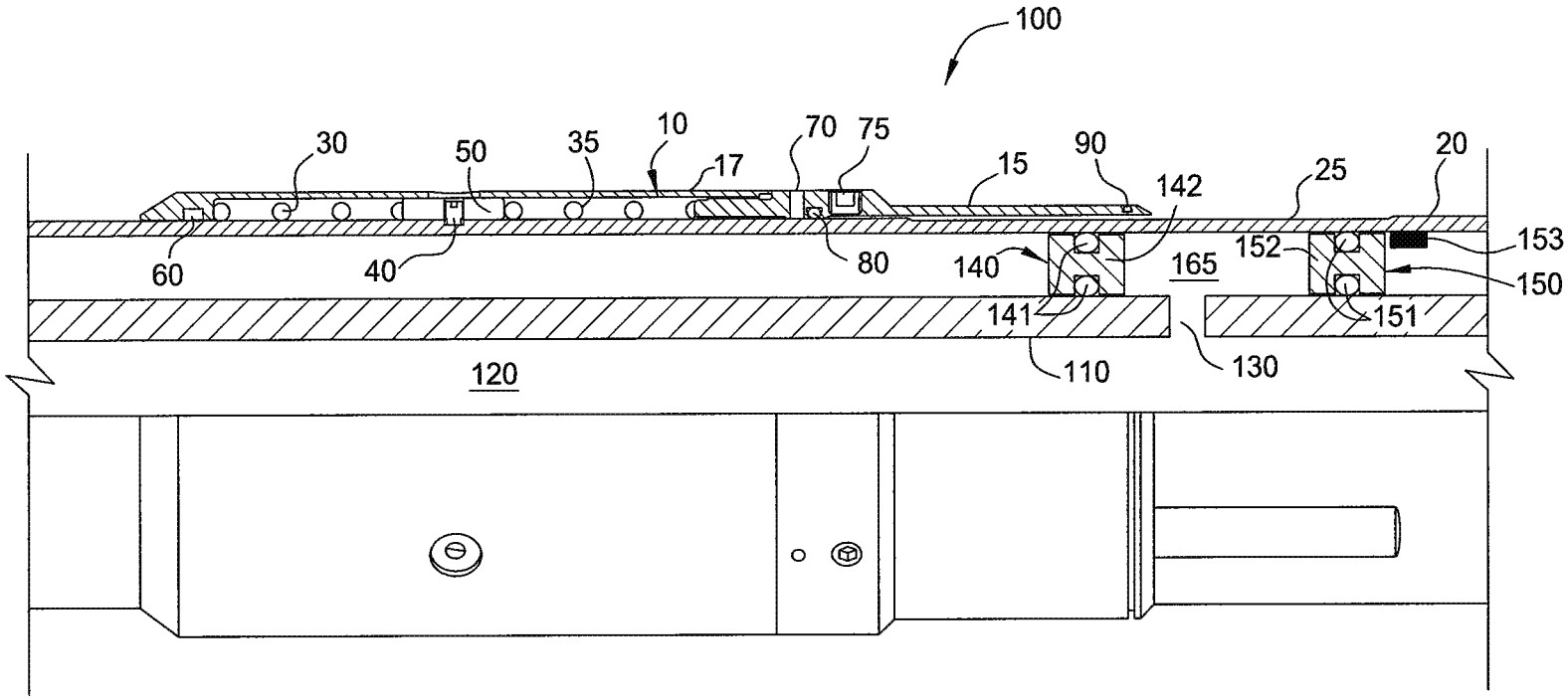
FIG. 1 illustrates a debris barrier assembly according to one embodiment.

FIG. 1 illustrates a debris barrier assembly 100 according to one embodiment. The debris barrier assembly 100 may include an outer housing assembly 10, a sleeve 20, a first biasing member 30, a second biasing member 35, and a support member 50. The outer housing assembly 10 may include an upper mandrel 17 that is threadedly or otherwise connected at its lower end to the upper end of a lower mandrel 15, each of which are disposed about the outer surface of the sleeve 20. In one embodiment, the upper and lower mandrels 15, 17 may be integral with each other and formed as a solid tubular member. The first biasing member 30, the support member 50, and the second biasing member 35 are each enclosed between the outer housing assembly 10 and the outer surface of the sleeve 20. In particular, the support member 50 is connected to the sleeve 20. In one embodiment, the support member 50 may be releaseably connected to the sleeve 20 via a release member 40, such as a shear screw. The first biasing member 30 is supported at its ends by an inner shoulder of the upper mandrel 17 and the upper end of the support member 50. And the second biasing member 35 is supported at its ends by the lower end of the support member 50 and the upper end of the lower mandrel 15. In this manner, the outer housing assembly 10 is movable along the outer surface of the sleeve 20 against the bias of the first and second biasing members 30, 35. In one embodiment, the first and second biasing members 30, 35 may include one or more springs. In one embodiment, the sleeve 20 may include a tubular member having a bore disposed through the body of the tubular member.

Figure 2:
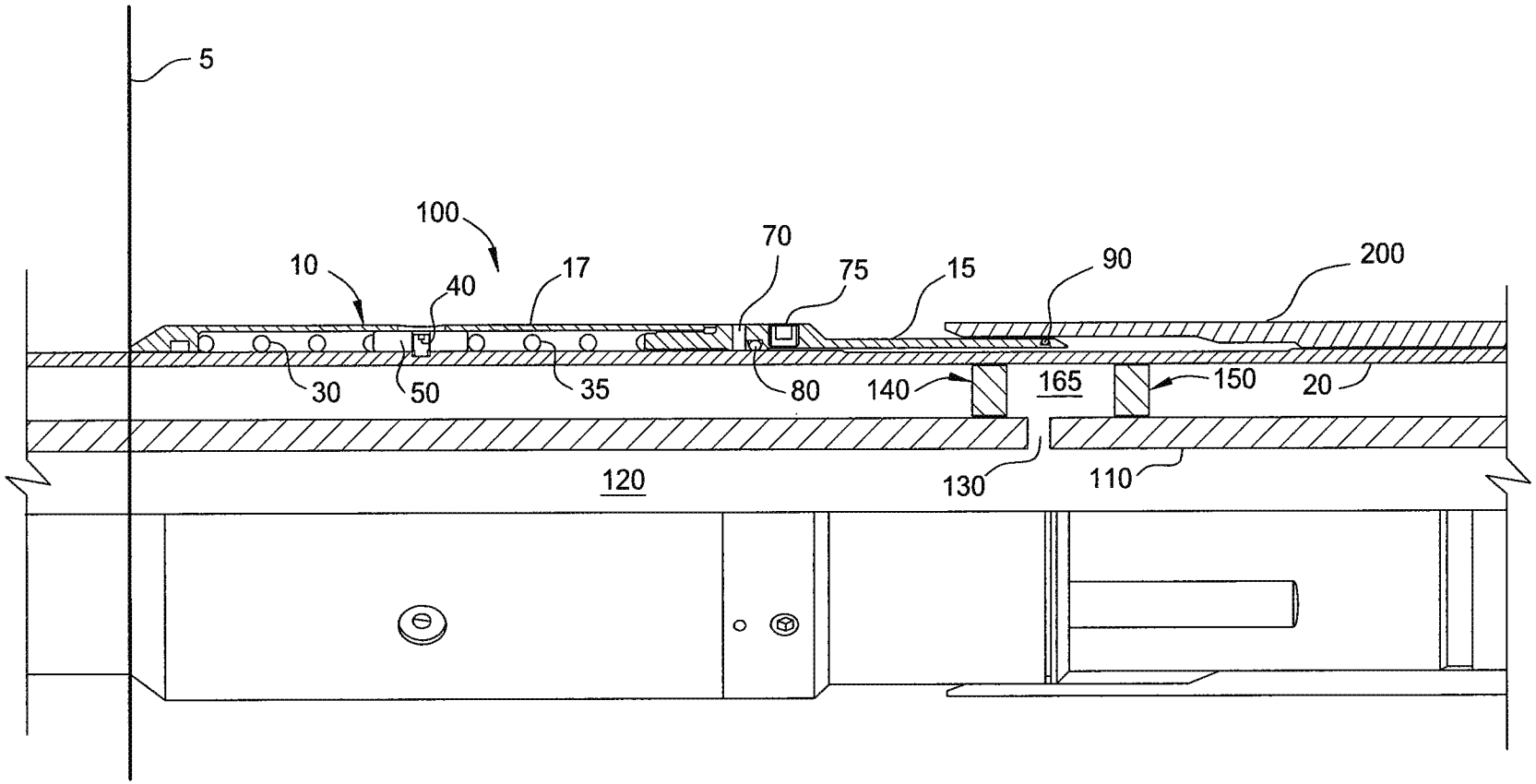
FIG. 2 illustrates the debris barrier assembly in a run-in position according to one embodiment.
Figure 3:
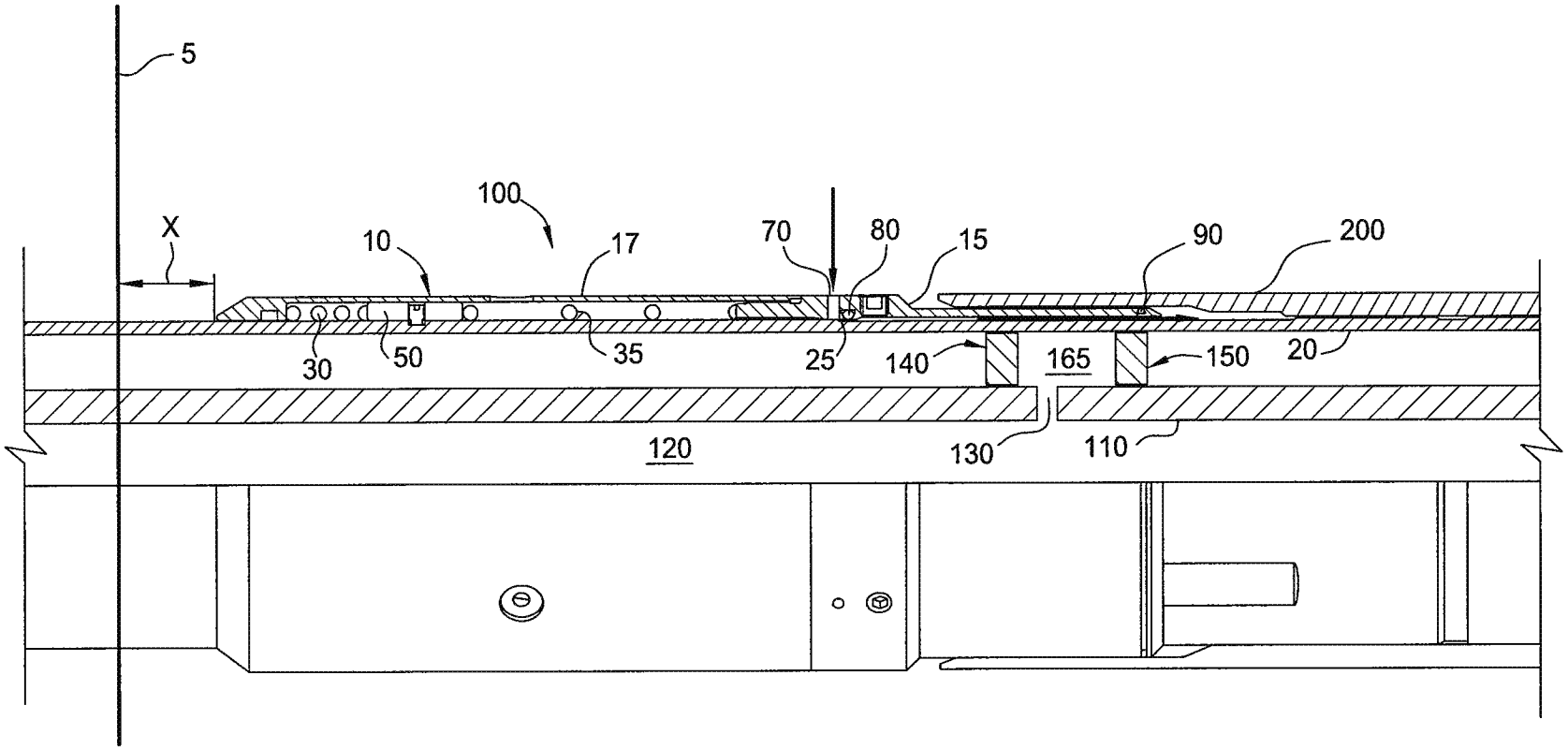
FIG. 3 illustrates the debris barrier assembly in a first compensation position according to one embodiment.
Figure 4:
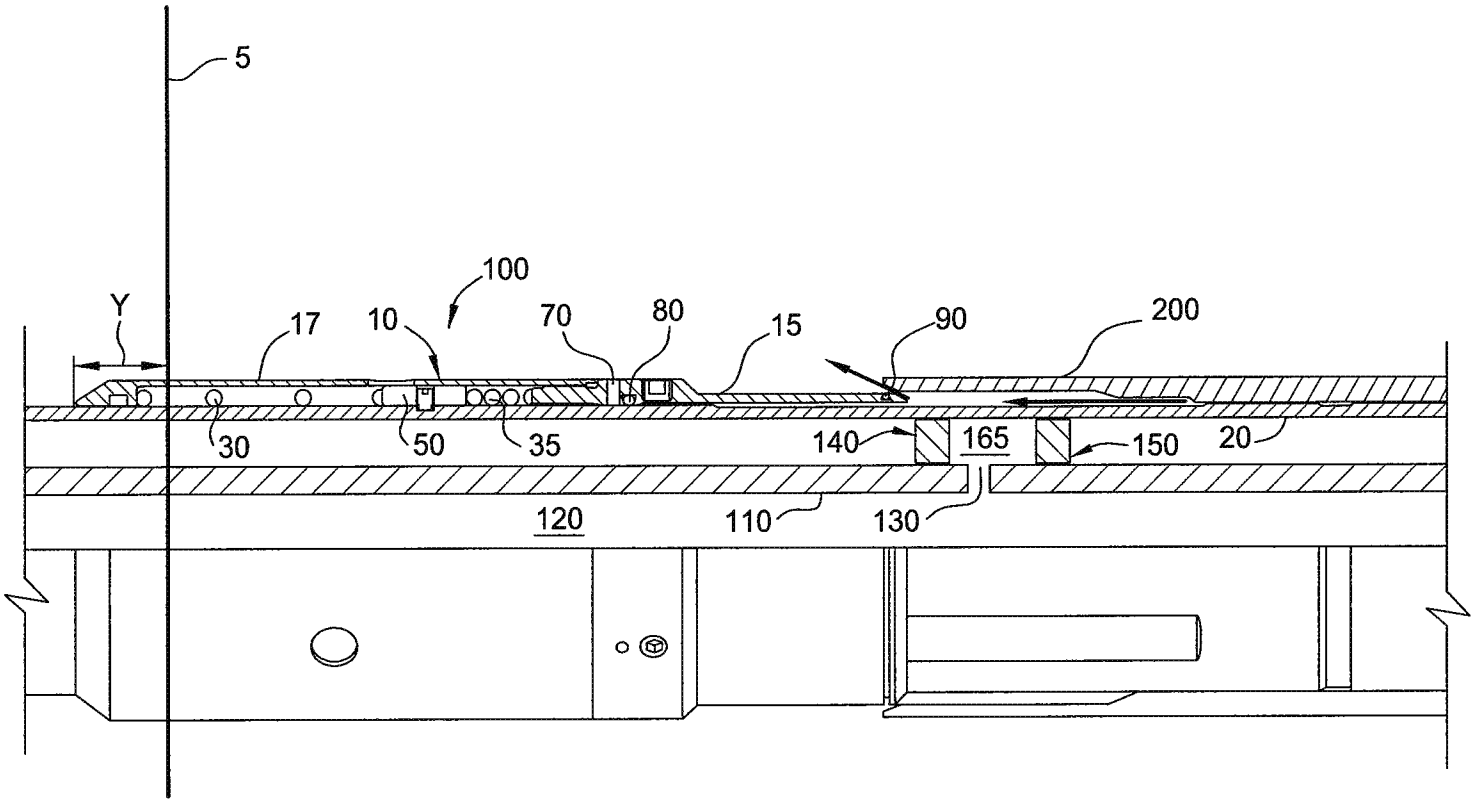
FIG. 4 illustrates the debris barrier assembly in a second compensation position according to one embodiment.

The upper mandrel 17 further includes an inner recess to support a retrieval member 60, such as a snap ring, that assists in the retrieval of the debris barrier assembly 100. The lower mandrel 15 further includes one or more equalization ports 70 and one or more fill ports 75, which are each disposed through the body of the lower mandrel 15. An inner recess is formed between the ports 70, 75 to support a seal member 80, such as an o-ring, that sealingly engages the outer surface of the sleeve 20. One or more equalization passages, such as equalization slots 25 may be disposed along the outer surface of the sleeve 20. The equalization slots 25 are arranged to provide a bypass around the seal member 80 to open fluid communication to the environment surrounding the debris barrier assembly 100 via the equalization ports 70. An outer recess may be formed at the lower end of the lower mandrel 15 to support a seal member 90, such as an o-ring, that sealingly engages the inner surface of a polished bore receptacle ("PBR") 200, as illustrated in FIGS. 2-4. In one embodiment, the PBR may include a tubular member having a polished bore disposed through the body of the tubular member.

In one embodiment, the sleeve 20 is lowered into a wellbore via a work string 110, which includes a flow bore 120. A seal assembly 140 and a seal assembly 150 are disposed between the inner surface of the sleeve 20 and the outer surface of the work string 110. In one embodiment, the seal assembly 140 may be a static seal assembly, and the seal assembly 150 may be a dynamic seal assembly. The seal assemblies 140, 150 may each include seal elements 141, 151, such as o-rings, and piston members 142, 152. The piston member 152 of the seal assembly 150 may abut an inner shoulder 153 of the sleeve 20. A port 130 disposed through the body of the work string 110 provides fluid communication between the flow bore 120 and a chamber 165 that is formed between the seal assemblies 140, 150. Pressurization of the chamber 165 via the flow bore 120 of the work string 110 may force the piston member 152 against the inner shoulder 153 to thereby move the sleeve 20 (relative to the work string 110) in a downward direction to actuate one or more downhole tools that are connected to the lower end of the sleeve 20. The seal assembly 140 may be affixed to the work string 110 and the seal assembly 150 may move along the outer surface of the work string 110. In one embodiment, one or more seal assemblies 140, 150 may be used in parallel to create a force sufficient to move the sleeve 20 to actuate one or more downhole tools. The debris barrier assembly 100 serves to protect the actuation mechanism of the one or more downhole tools via the sleeve 20 as further described herein.

In one embodiment, sleeve 20 may be movable relative to the work string 110 to thereby set a downhole tool that is connected to the sleeve 20. In one embodiment, the sleeve 20 may be affixed to the work string 110 such that there is no relative axial movement between sleeve 20 and the work string 110. The sleeve 20 may be affixed to the work string 110, and one or more seal assemblies, such as seal assemblies 140, 150 may be disposed between the outer surface of the work string 110 and the inner surface of the sleeve 20. When the sleeve 20 is affixed to the work string 110, the sleeve 20 may or may not be configured to facilitate the setting of one or more downhole tools. In one embodiment, the one or more downhole tools may include an expansion tool, a conventional liner hanger, an expandable liner hanger, a packer, a patch, and other wellbore devices.

FIG. 2 illustrates the debris barrier assembly 100 in a run-in position. The debris barrier assembly 100 and the PBR 200 may be assembled at the wellbore surface prior to run-in. The debris barrier assembly 100 may be coupled to the sleeve 20 via the release member 40, and the sleeve 20 may be inserted into the PBR 200 using the work string 110. One or more engagement members (such as engagement member 525 illustrated in FIGS. 7A-F) may be disposed on the work string 110 and may be used to couple the work string 110 to the PBR 200. One or more seal members (such as seal member 600 illustrated in FIGS. 7A-F) may be disposed on the work string 110 and may be used seal the lower end of the PBR 200. When the work string 110 is coupled to the PBR 200, the debris barrier assembly 100 is located in the run-in position.

A reference point 5 is shown in FIGS. 2-4 to illustrate the movement or stroke of the outer housing assembly 10 relative to the sleeve 20 and the work string 110. The seal member 80 is slidably sealed against the outer surface of the sleeve 20, and the seal member 90 is slidably sealed against the inner surface of the PBR 200. Clean fluid may be filled into the PBR 200 through at least one of the fill ports 75. As fluid is pumped into the PBR 200, air may be purged from the PBR 200 through one of the other fill ports 75 and/or by forcing the seal member 90 above the upper end of the PBR 200 (as illustrated in FIG. 4) against the bias of the second biasing member 35. After filling and purging, the second biasing member 35 returns the outer housing assembly 10 to the run-in position, and the fill ports 75 may be plugged closed. In this manner, the PBR 200 encloses a clean fluid volume for dynamic actuation of one or more downhole tools that are connected to the sleeve 20 and are disposed within the clean fluid volume.

In the run-in position, a recessed lower end of the lower mandrel 15 is partially disposed within a recessed upper end of the PBR 200, where both seal members 80, 90 are slidably sealing the clean fluid volume within the PBR 200. While running in the wellbore and/or during one or more downhole operations, the external pressure in the environment surrounding the debris barrier assembly 100 and the PBR 200 may exceed the internal pressure of the clean fluid volume sealed within the PBR 200. The pressure differential will force the outer housing assembly 10 to move towards the PBR 200 against the bias of the first biasing member 30 to compensate for the pressure increase and thereby maintain substantially equal external and internal pressures. The debris barrier assembly 100 is operable to compensate for pressure differentials without allowing the transfer of fluid between the interior of the PBR 200 and the surrounding wellbore environment. The debris barrier assembly 100 may be configured to compensate for pressure differentials within a pre-determined range by movement of the outer housing assembly 10 toward and/or away from the PBR 200 without allowing fluid transfer. If, however, this pressure differential is enough to compress the first biasing member 30 beyond a predetermined stroke of the outer housing assembly 10, then the seal member 80 will disengage from its seal against the sleeve 20 as it moves over the equalization slots 25 on the sleeve 20. As illustrated in FIG. 3, the outer housing assembly 10 has moved a distance X below the reference point 5 of the run-in position, such that the seal member 80 is positioned over the equalization slots 25. This will allow fluid external to the PBR 200 to enter through the equalization ports 70, bypass the seal member 80, and flow into the PBR 200. The volume of fluid passed will typically be insignificant compared with the overall clean fluid volume, and therefore unlikely to cause any actuation malfunction. When the internal pressure approaches the magnitude of the external pressure, the first biasing member 30 may then return the debris barrier assembly 100 towards the run-in position.

Conversely, if thermal or other effects (for example owing to fluid circulation) cause the internal pressure within the clean fluid volume to exceed the external pressure in the surrounding environment, the debris barrier assembly 100 is also configured to compensate for this opposing pressure differential. In particular, the outer housing assembly 10 will move away from the PBR 200 against the bias of the second biasing member 35, as illustrated in FIG. 4, to compensate for the pressure increase and to maintain substantially equal internal and external pressures. The debris barrier assembly 100 is operable to compensate for pressure differentials without allowing the transfer of fluid between the surrounding wellbore environment and the interior of the PBR 200. The debris barrier assembly 100 may be configured to compensate for pressure differentials within a pre-determined range by movement of the outer housing assembly 10 toward and/or away from the PBR 200 without allowing fluid transfer. If, however, this pressure differential is excessive enough to compress the second biasing member 35 beyond a predetermined stroke of the outer housing assembly 10, then the seal member 90 will disengage from its seal against the PBR 200 as it moves above the upper end to vent the excess internal pressure into the surrounding environment. As illustrated in FIG. 4, the outer housing assembly 10 has moved a distance Y above the reference point 5 of the run-in position, such that the seal member 90 is positioned above the upper end of the PBR 200. The second biasing member 35 may then return the debris barrier assembly 100 towards the run-in position as the pressures equalize. During the course of run-in and/or during downhole operations, the debris barrier assembly 100 may repeatedly compensate for various pressure differentials and prevent any substantial contamination of the clean fluid volume within the PBR 200.

To actuate and/or upon actuation of the one or more downhole tools that are connected to the sleeve 20, the mounting position of the outer housing assembly 10 relative to the sleeve 20 may need to be changed to permit additional stroking of the sleeve 20. The outer housing assembly 10 is therefore releasably coupled to the sleeve 20 via the releasable member 40. FIGS. 5A-5D illustrate a run-in, setting, release, and retrieval sequence using the debris barrier assembly 100, according to one embodiment. The seal assemblies 140, 150 are omitted from FIGS. 5C-5D for clarity purposes.

Figures 5A, 5B, 5C, 5D:
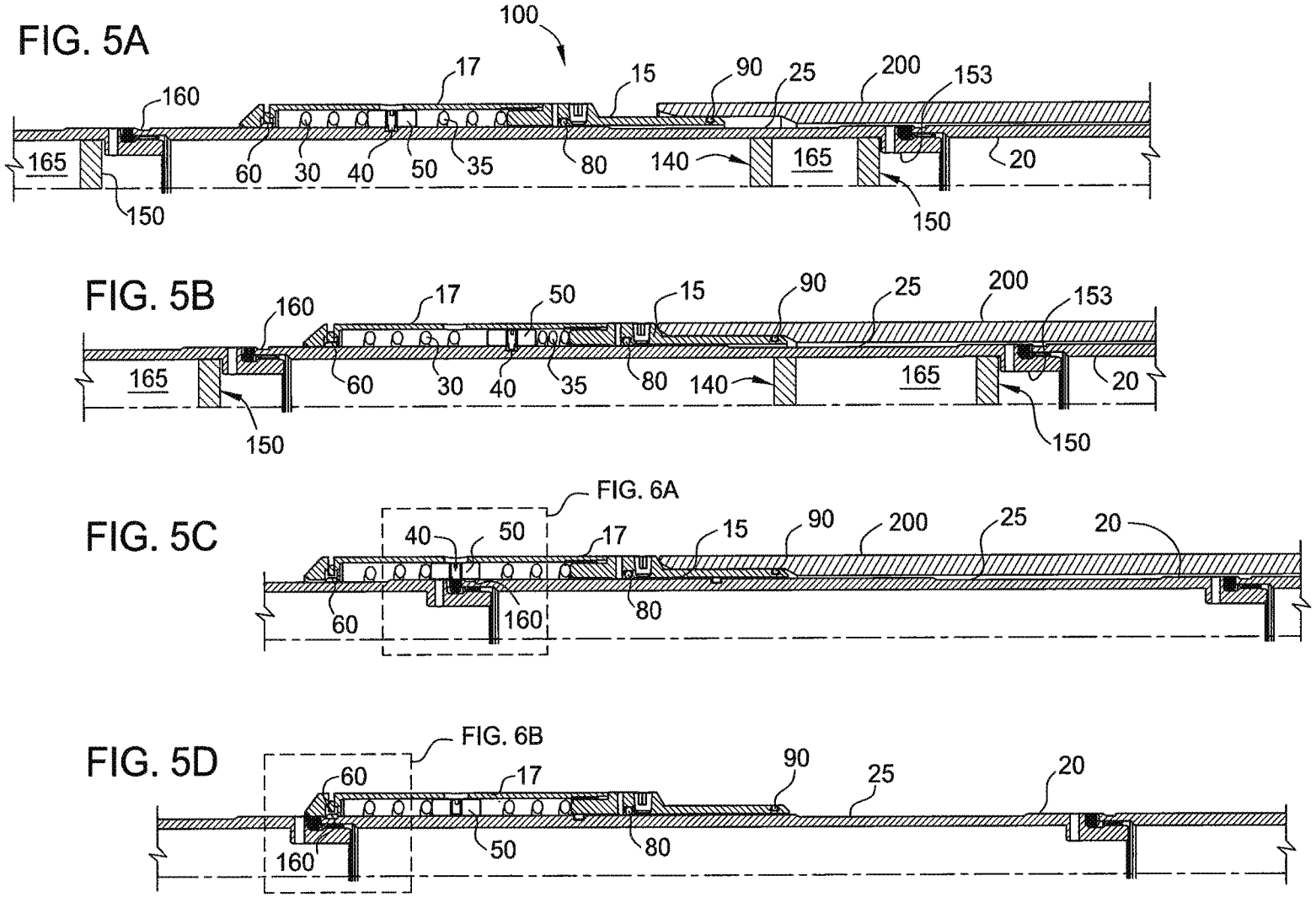
FIGS. 5A-5D illustrate a run-in, setting, release, and retrieval position of the debris barrier assembly according to one embodiment.

FIG. 5A illustrates the run-in position of the debris barrier assembly 100 and the PBR 200 as discussed above with respect to FIG. 2. FIG. 5B illustrates the debris barrier assembly 100 after the sleeve 20 has been actuated via pressurization of the chamber 165 as discussed above with respect to FIG. 1. As illustrated, the sleeve 20 moves downward into the PBR 200 until the lower mandrel 15 engages the upper end of the PBR 200 and the support member 50 compresses the second biasing member 35. Continued movement of the sleeve 20 in the downward direction will generate a reaction force in the outer housing assembly 10 that causes the release member 40 to release the connection between the support member 50 and the sleeve 20. FIG. 5C illustrates the sleeve 20 decoupled from the support member 50 and thus the outer housing assembly 10. The sleeve 20 may continue to be moved any amount of stroke necessary to actuate and/or complete actuation of one or more downhole tools, while the outer housing assembly 10 prevents contamination of the clean fluid volume within the PBR 200. In one embodiment, the release member 40 may be an optional feature to permit additional movement of the sleeve 20 relative to the outer housing assembly 10. In one embodiment, the release member 40 may not need to be released from its engagement with the sleeve 20, and can therefore be used with the support member 50 to retrieve the outer housing assembly 10. In one embodiment, the support member 50 may be coupled to or integral with the sleeve 20, and can be used to retrieve the outer housing assembly 10.

Figure 6A:
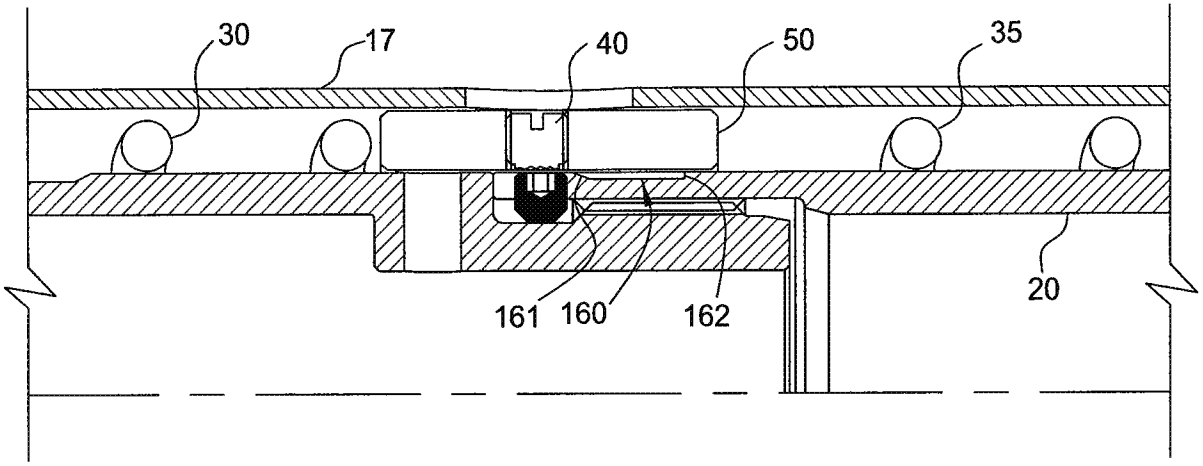
FIGS. 6A and 6B illustrate a unidirectional groove of the debris barrier assembly according to one embodiment.

As the sleeve 20 is moved in the downward direction relative to the outer housing assembly 10, the retrieval member 60 may move into and out of a unidirectional groove 160 that is disposed on the outer surface of the sleeve 20. The retrieval member 60 and the unidirectional groove 160 are configured to reconnect the outer housing assembly 10 and the sleeve 20 so that they can be retrieved from the wellbore together as further described herein. As illustrated FIGS. 6A-6B, the unidirectional groove 160 includes a tapered edge 161 on one side and a straight edge 162 on the opposite side. As the sleeve 20 moves in the downward direction, the unidirectional groove 160 will encounter the retrieval member 60 from the straight edge 162 side. The retrieval member 60 may extend into the unidirectional groove 160 as it passes underneath the retrieval member 60. Further movement of the sleeve 20 in the downward direction will force the retrieval member 60 out of the unidirectional groove 160 as it encounters the tapered edge 161. FIG. 6A illustrates the sheared releasable member 40 and the unidirectional groove 160 after moving across the retrieval member 60.

Figure 6B:
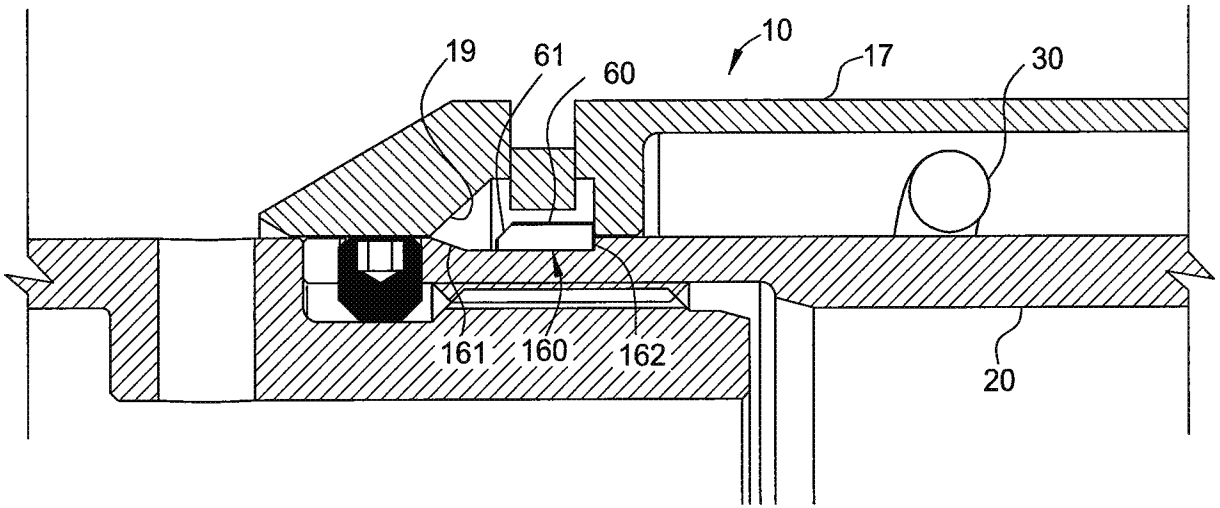

FIG. 5D illustrates the sleeve 20 being retrieved from the wellbore via the work string 110, such as after actuation of the one or more downhole tools. The work string 110 may be detached from the PBR 200 so that it remains in the wellbore. As the sleeve 20 is being retrieved, drag and/or the weight of the outer housing assembly 10 will cause relative movement between it and the sleeve 20 so that the retrieval member 60 will again encounter the unidirectional groove 160. However, movement of the sleeve 20 in the upward direction will cause the retrieval member 60 to initially encounter the unidirectional groove 160 on the tapered edge 161 side and then engage the straight edge 162 side of the groove. As illustrated in FIG. 6B, the contact between the retrieval member 60 and the straight edge 162 of the unidirectional groove 160 re-couples the outer housing assembly 10 to the sleeve 20 so that it can be retrieved from the wellbore with the sleeve 20 via the work string 110.

FIG. 6B further illustrates a tapered edge 19 that is provided on the inner shoulder of the upper mandrel 17, which corresponds to a tapered edge 61 of the retrieval member 60. During retrieval, as the sleeve 20 is moved in the upward direction relative to the upper mandrel 17, the retrieval member 60 may move into the unidirectional groove 160 and seat against the straight edge 162. The straight edge 162 may then move the retrieval member 60 into contact with the tapered edge 19 of the upper mandrel 17, thereby forcing the retrieval member 60 into the unidirectional groove 160. The tapered edges 19, 61 may engage to secure the retrieval member 60 within the unidirectional groove 160 against the straight edge 162 to prevent inadvertent release of the outer housing assembly 10 from the sleeve 20 during retrieval. In one embodiment, the sleeve 20 may include one or more "back-up" unidirectional grooves 160 in the event that the retrieval member 60 fails to engage and/or disengages from the initial unidirectional groove 160 during retrieval.

Figure 7A:
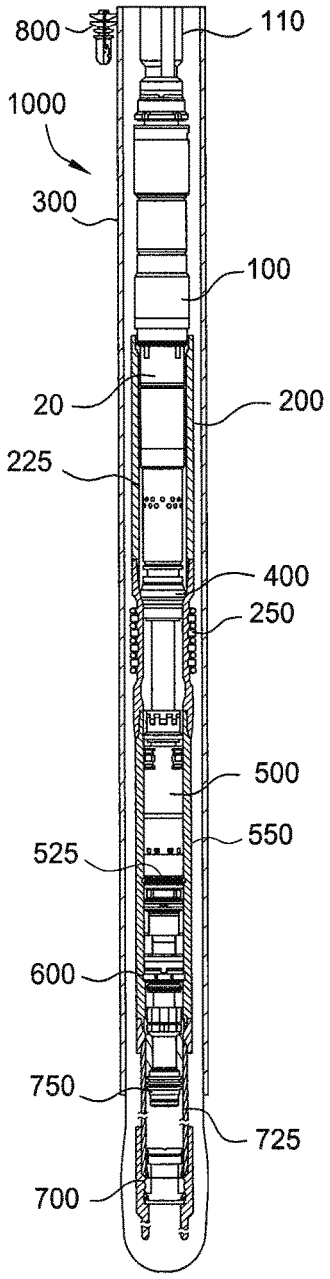
FIGS. 7A-7F illustrate an operational sequence of a downhole assembly that includes the debris barrier assembly according to one embodiment.

FIGS. 7A-7F illustrate an operational sequence of a downhole assembly 1000, which includes the debris barrier assembly 100, according to one embodiment. FIG. 7A-1 is a schematic representation of the embodiment illustrated in FIG. 7A. As illustrated in FIG. 7A, the downhole assembly 1000 includes the work string 110, the debris barrier assembly 100, the sleeve 20, the PBR 200, the clean fluid volume 225, a downhole tool 400, an expandable tubular 250, a running tool 500, a running tool sub 550, an engagement member 525, a seal member 600, a landing sub 700, a liner 725, and a plug member 750. The lower end of the PBR 200 is coupled to the upper end of the expandable tubular 250. The lower end of the expandable tubular 250 is coupled to the upper end of the running tool sub 550. The lower end of the running tool sub 550 is coupled to the upper end of the liner 725. The landing sub 700 is coupled to the lower end of the liner 725.

The PBR 200, the expandable tubular 250, the running tool sub 550, the liner 725, and the liner sub 700 are supported by the work string 110 via the engagement member 525. In one embodiment, the engagement member 525 may include one or more retractable dogs that engage the inner surface of the running tool sub 525. In one embodiment, the running tool 500 actuates the engagement member 525 into engagement with the running tool sub 550.

When the engagement member 525 is coupled to the running tool sub 550, the debris barrier assembly 100 is located in the run-in position as illustrated in FIG. 2. The seal members 80, 90 of the debris barrier assembly 100 form the upper seal of the clean fluid volume 225 with the inner surface of the PBR 200. The seal member 600 is coupled to the work string 110 and is sealingly disposed within the running tool sub 550 to form the lower seal of the clean fluid volume 225. In one embodiment, the running tool 500 actuates the seal member 600 into engagement with the running tool sub 550. The clean fluid volume 225 occupies the area between the inner surfaces of the PBR 200, the expandable tubular 250, and the running tool sub 550 and the outer surfaces of the components coupled to the work string 110. The debris barrier assembly 100 protects the clean fluid volume 225 from contamination that may otherwise disrupt operation of the downhole tool 400. The debris barrier assembly 100 also compensates for any pressure differential between the external wellbore environment and the internal clean fluid volume environment to thereby maintain a substantially neutral pressure working environment for operation of the downhole tool 400.

In one embodiment, the expandable tubular 250 may be a liner hanger and/or a packer configured to anchor and seal the liner 725 within the wellbore 300. In one embodiment, the wellbore 300 may be lined with a casing or other tubular member, and the expandable tubular 250 may be configured to secure the liner 725 to the lower end of the wellbore casing or tubular member. In one embodiment, the expandable tubular 250 may include one or more sealing elements and/or one or more gripping elements configured to engage the inner surface of the wellbore 300 to secure the liner 725 in the wellbore 300. In one embodiment, the downhole tool 400 may include a tubular expansion member, such as a compliant cone, that is configured to expand the expandable tubular 250. The sleeve 20 may be coupled to the downhole tool 400 and may be configured to actuate the downhole tool 400 as described above with respect to FIG. 1 and FIGS. 5A-5B. In one embodiment, the sleeve 20 may be operable to move the downhole tool 400 through the expandable tubular 250 to expand the tubular into engagement with the wellbore 300.

Figure 7B:
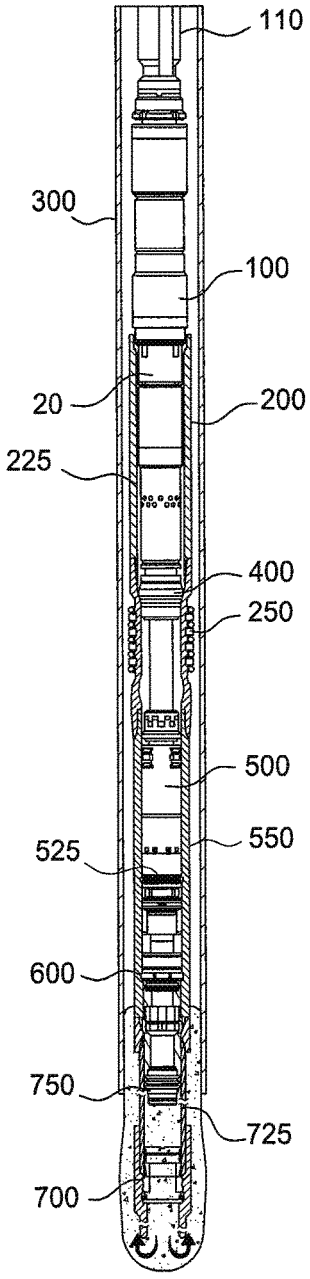
Figure 7C:
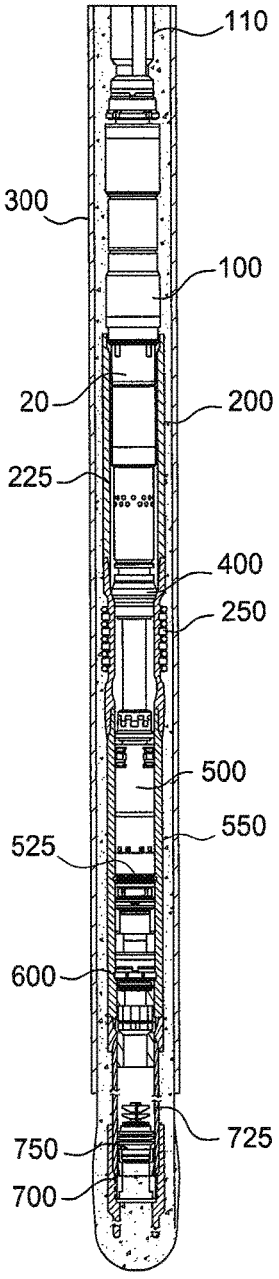

As illustrated in FIGS. 7A-7C, the downhole assembly 1000 is run into the wellbore 300 via the work string 110 to a predetermined location, such as near the lower end of a casing or liner that is cemented or otherwise secured in the wellbore 300. Cement and/or other wellbore treatment fluids may be supplied through the flow bores of the work string 110, the liner 725, and the landing sub 700 to fill the wellbore 300 annulus surrounding the assembly 1000. After the filling operation, a dart member 800 may be directed through the work string 110 to purge the remainder of the cement or other wellbore treatment fluids from the flow bore of the work string 110. The dart member 800 may seat on the upper end of the plug member 750 and seal the lower end of the flow bore of the work string 110. The work string 110 may then be pressurized to release the dart member 800 and the plug member 750 from the bottom end of the work string 110 to purge the remainder of the cement or other wellbore treatment fluids from the liner 725 and the landing sub 700. The dart member 800 and the plug member 750 may sealingly engage the inner surface of the landing sub 700 to prevent re-entry of cement and/or other wellbore fluids into the landing sub 700, the liner 725, and/or the work string 110. During the run-in and cementing/treatment processes, the debris barrier assembly 100 may be operable to protect the clean fluid volume 225 and the work string 110 components from contamination by the cement and/or other wellbore fluids and debris.

Figure 7D:
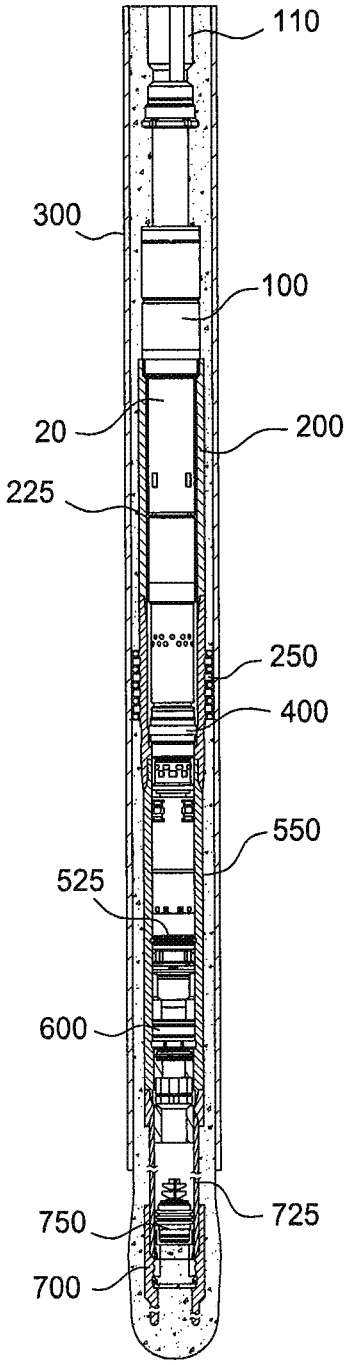

FIG. 7D illustrates the operation of the downhole tool 400. As illustrated, the flow bore of the work string 110 is pressurized to actuate and move the sleeve 20 in a downward direction as described above with respect to FIG. 1 and FIGS. 5A-5B. The sleeve 20 moves the downhole tool 400 through the expandable tubular 250 to thereby expand the tubular into engagement with the wellbore 300. At any point during the operation of the downhole tool 400, the outer housing assembly 10 may be decoupled from the sleeve 20 by release of the release member 40 as described above with respect to FIG. 5C. During the downhole operation, the debris barrier assembly 100 may be operable to protect the clean fluid volume 225 and the work string 110 components from contamination by the cement and/or other wellbore fluids and debris.

Figure 7E:
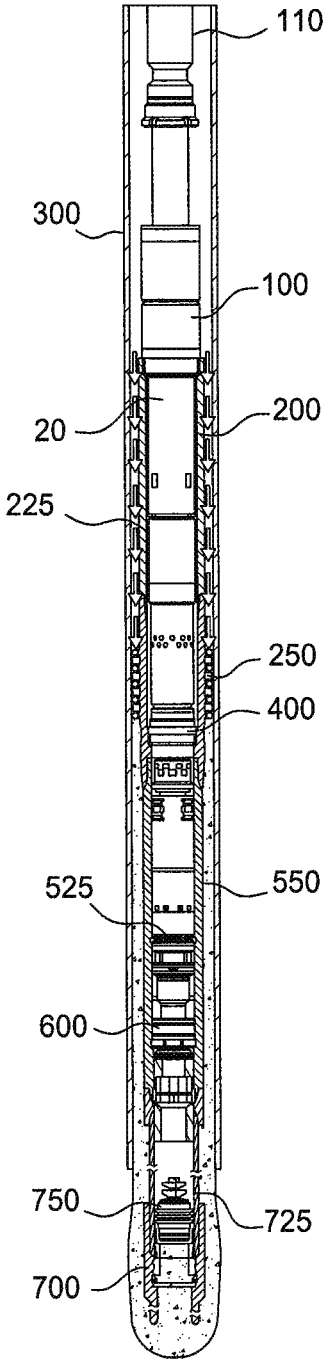

FIG. 7E illustrates a pressure test that is preformed to test the integrity of the seal between the expandable tubular 250 and the wellbore 300. In one embodiment, the annulus of the wellbore 300 located above the expanded expandable tubular 250 may be pressurized from the surface to determine if the expandable tubular 250 properly formed a seal with the wellbore 300. In one embodiment, the downhole tool 400 may be actuated one or more times via the sleeve 20 after pressure testing of the seal.

Figure 7F:
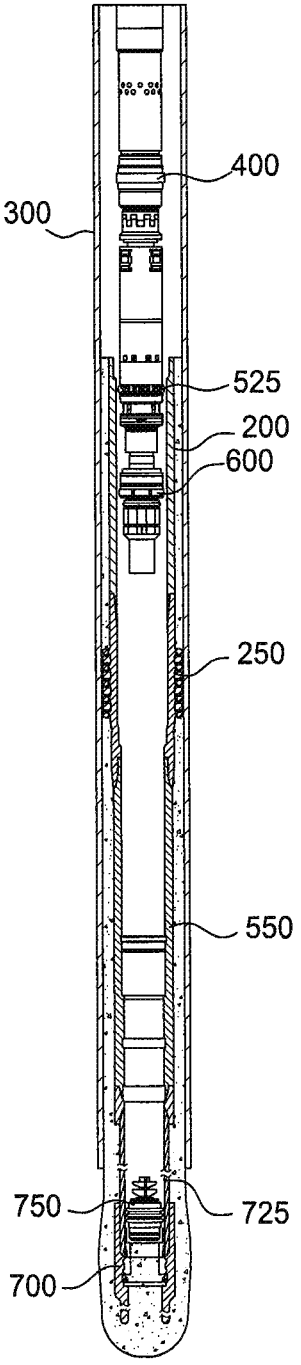
Figures 1, 7A:
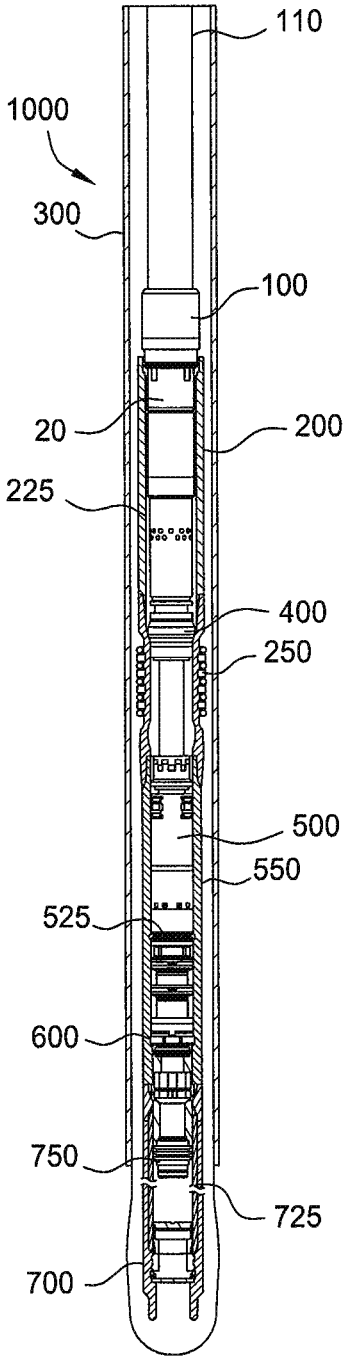

FIG. 7F illustrates the retrieval of the work string 110, the debris barrier assembly 100, the downhole tool 400, the running tool 500, and the seal member 600. The PBR 200, the expandable tubular 250, the running tool sub 550, the liner 725, and the landing sub 700 remain in the wellbore 300 and are secured/supported by the expanded expandable tubular 250. In one embodiment, the running tool 500 is actuated to disengage the engagement member 525 and/or the seal member 600 from engagement with the running tool sub 550. The work string 110 and its components may then be lifted to the surface. As described above with respect to FIGS. 5D and 6B, during retrieval, the retrieval member 60 of the outer housing assembly 10 may engage the unidirectional groove 160 on the sleeve 20 so that the debris barrier assembly 100 is also retrieved from the wellbore 300 with the work string 110.

In one embodiment, the debris barrier assembly is operable to prevent downhole debris, such as solids, fill, scale, cuttings, etc., and/or cement and muds with suspended weight materials, from entering the clean fluid volume region. In one embodiment, the debris barrier assembly is operable to maintain the clean fluid volume region at substantially the same pressure relative to the wellbore environment so that hydraulic, mechanical, and/or electromechanical-types of actuation can be performed without disruption. In one embodiment, the sleeve, downhole tools, and/or running tools may be actuated using hydraulic, mechanical, and/or electromechanical-types of actuation.

While the foregoing is directed to embodiments of the invention, other and further embodiments of the invention may be devised without departing from the basic scope thereof, and the scope thereof is determined by the claims that follow.

The invention claimed is:

1. A debris barrier assembly, comprising:

a sleeve;

a housing coupled to the sleeve;

a first biasing member and a second biasing member disposed within the housing; and a support member disposed between the first biasing member and the second biasing member, wherein the support member is coupled to the sleeve and disposed within the housing and the first biasing member and the second biasing member biasing the housing in opposite directions, and wherein when the debris barrier assembly is in a run-in position, the housing is axially movable relative to the support member.

2. The assembly of claim 1, wherein the support member is releasable from the sleeve when the debris barrier assembly is positioned downhole.

3. The assembly of claim 1, wherein the support member is releasable toward a lower end of the debris barrier assembly.

4. The assembly of claim 1, wherein the housing is slidingly disposed on an outer surface of the sleeve.

5. The assembly of claim 1, further comprising a retrieval member coupled to the housing.

6. The assembly of claim 5, wherein the retrieval member is configured to engage a groove formed on the sleeve.

7. The assembly of claim 6, wherein one end of the groove forms a straight edge that is substantially perpendicular to a longitudinal axis of the sleeve, and an opposite end of the groove forms a tapered edge along which the retrieval member is configured to engage to move out of the groove.

8. The assembly of claim 7, further comprising an outer seal disposed on an outer surface of the housing.

9. The assembly of claim 1, further comprising an inner seal disposed between an inner surface of the housing and an outer surface of the sleeve.

10. The assembly of claim 1, wherein the first biasing member and the second biasing member are configured to move the housing.

11. The assembly of claim 1, wherein the first biasing member and the second biasing member are mechanical biasing members.

12. The assembly of claim 1, wherein the first biasing member and the second biasing member bias the housing.

13. A debris barrier assembly, comprising:

a sleeve;

a housing coupled to the sleeve;

a first mechanical biasing member and a second mechanical biasing member disposed within the housing, wherein the housing is moveable in one direction from a run-in position to a first position against a bias force of the first mechanical biasing member, and wherein the housing is movable in an opposite direction from the run-in position to a second position against a bias force of the second mechanical biasing member; and a support member coupled to the sleeve and disposed between the first and second mechanical biasing members, the support member being releaseable from the sleeve downhole.

14. The assembly of claim 13, wherein the support member is in contact with an end of the first mechanical biasing member and an end of the second mechanical biasing member.

15. The assembly of claim 13, further comprising an inner seal disposed between an inner surface of the housing and an outer surface of the sleeve.

16. The assembly of claim 15, further comprising an outer seal disposed on an outer surface of the housing.

17. The assembly of claim 13, further comprising a retrieval member coupled to the housing.

18. The assembly of claim 17, wherein the retrieval member is configured to engage a groove formed on the sleeve.

19. The assembly of claim 18, wherein one end of the groove forms a straight edge that is substantially perpendicular to a longitudinal axis of the sleeve, and an opposite end of the groove forms a tapered edge along which the retrieval member is configured to engage to move out of the groove.

20. The assembly of claim 19, wherein the retrieval member is a snap ring.

21. A debris barrier assembly, comprising:

a sleeve;

a housing coupled to the sleeve;

a first seal disposed between an inner surface of the housing and an outer surface of the sleeve;

a second seal disposed on an outer surface of the housing;

a first biasing member and a second biasing member disposed within the housing; and a support member disposed between the first biasing member and the second biasing member, wherein the support member is coupled to the sleeve and disposed within the housing, the support member being releasable from the sleeve downhole.

22. The assembly of claim 21, wherein the support member is releasably coupled to the sleeve by one or more release members.

23. The assembly of claim 22, wherein the release members are shear screws.

24. The assembly of claim 21, further comprising a retrieval member coupled to the housing.

25. The assembly of claim 24, wherein the retrieval member is configured to engage a groove formed on the sleeve.

26. The assembly of claim 25, wherein one end of the groove forms a straight edge that is substantially perpendicular to a longitudinal axis of the sleeve, and an opposite end of the groove forms a tapered edge along which the retrieval member is configured to engage to move out of the groove.

27. The assembly of claim 26, wherein the retrieval member is a snap ring.

* * * * *